US005639059A

United States Patent [19]

Nash

[11] Patent Number: 5,639,059

[45] Date of Patent: Jun. 17, 1997

[54] SUPPORT FOR A SEAT

[76] Inventor: Adrian Nash, 18 Warburton Highway, Lilydale, Victoria, Australia

[21] Appl. No.: 407,924

[22] Filed: Mar. 21, 1995

[30] Foreign Application Priority Data

Mar. 22, 1994 [AU] Australia ..... PM4633/94

[51] Int. Cl.[6] ..... F16M 13/00

[52] U.S. Cl. ..... 248/619; 248/157; 248/616; 267/34; 114/363

[58] Field of Search ..... 248/619, 423, 248/415, 416, 616, 157; 267/221, 224, 34; 297/344.19; 114/363

[56] References Cited

U.S. PATENT DOCUMENTS

| | | | |
|---|---|---|---|
| D. 317,539 | 6/1991 | Goldsmith | D6/495 |
| 2,529,861 | 11/1950 | Angell et al. | 248/415 |
| 3,179,364 | 4/1965 | Jackson et al. | 248/619 |
| 3,381,952 | 5/1968 | Stubblefield | 267/34 |
| 3,642,320 | 2/1972 | Ward | 297/345 |
| 3,758,064 | 9/1973 | Swaki | 248/403 |
| 3,857,555 | 12/1974 | Mori et al. | 267/34 |
| 4,640,484 | 2/1987 | Lamond et al. | 248/407 |
| 4,779,855 | 10/1988 | Tanaka | 267/221 |
| 4,842,238 | 6/1989 | Toiyama | 248/562 |
| 4,901,968 | 2/1990 | Ellis et al. | 248/407 |
| 5,171,063 | 12/1992 | Stidd | 297/344 |

FOREIGN PATENT DOCUMENTS

| | | |
|---|---|---|
| 84892/82 | 12/1982 | Australia . |
| 66788/81 | 7/1984 | Australia . |
| 54186/86 | 9/1986 | Australia . |
| 63111/86 | 5/1987 | Australia . |
| 71755/87 | 10/1987 | Australia . |
| 48366/85 | 12/1987 | Australia . |
| 18220/88 | 1/1989 | Australia . |
| 71340/87 | 12/1990 | Australia . |

*Primary Examiner*—Derek J. Berger
*Assistant Examiner*—Anita M. King
*Attorney, Agent, or Firm*—Harness, Dickey & Pierce P.L.C.

[57] ABSTRACT

A shock absorbing assembly for coupling to a pedestal for mounting a seat of a boat, the shock absorbing assembly including a shock absorber mounted in a housing, a pair of guide shafts being provided and being slidably mounted through the housing.

16 Claims, 4 Drawing Sheets

SUPPORT FOR A SEAT

BACKGROUND OF THE INVENTION

This invention relates to a support for a seat.

More particularly, the invention relates to a support for a seat for use in a boat where occupants are subjected to buffeting when in rough water. It is to be understood, however, that the principles of the invention can be applied to other seats which require shock absorption.

According to the present invention there is provided a shock absorbing assembly for a seat comprising at least one shock absorber coupled between the assembly and a support member for the seat.

The support member for the seat may comprise a pedestal or the like.

Preferably, the support includes at least one guide assembly comprising a guide tube and a guide shaft mounted for sliding movement in the guide tube, the assembly being coupled to the support member and the shock absorber to provide lateral support for the shock absorber.

Preferably further, there are two of said guide assemblies.

Preferably further, the support member includes a housing in which the shock absorber is mounted and the two guide assemblies are coupled to the housing.

Preferably further, a compression spring extends between the support member and the housing.

The invention also provides a shock absorbing assembly for coupling between a seat and a support structure for the seat, said mounting assembly comprising:

first mounting means for connecting the shock absorbing assembly to the support structure;

second mounting means for connecting the shock absorbing assembly to the seat; and shock absorbing means coupled between the first and second mounting means.

DESCRIPTION OF THE DRAWINGS

The invention will now be further described with reference to the accompanying drawings, in which.

DESCRIPTION OF THE PREFERRED EMBODIMENTS

Figure 1:
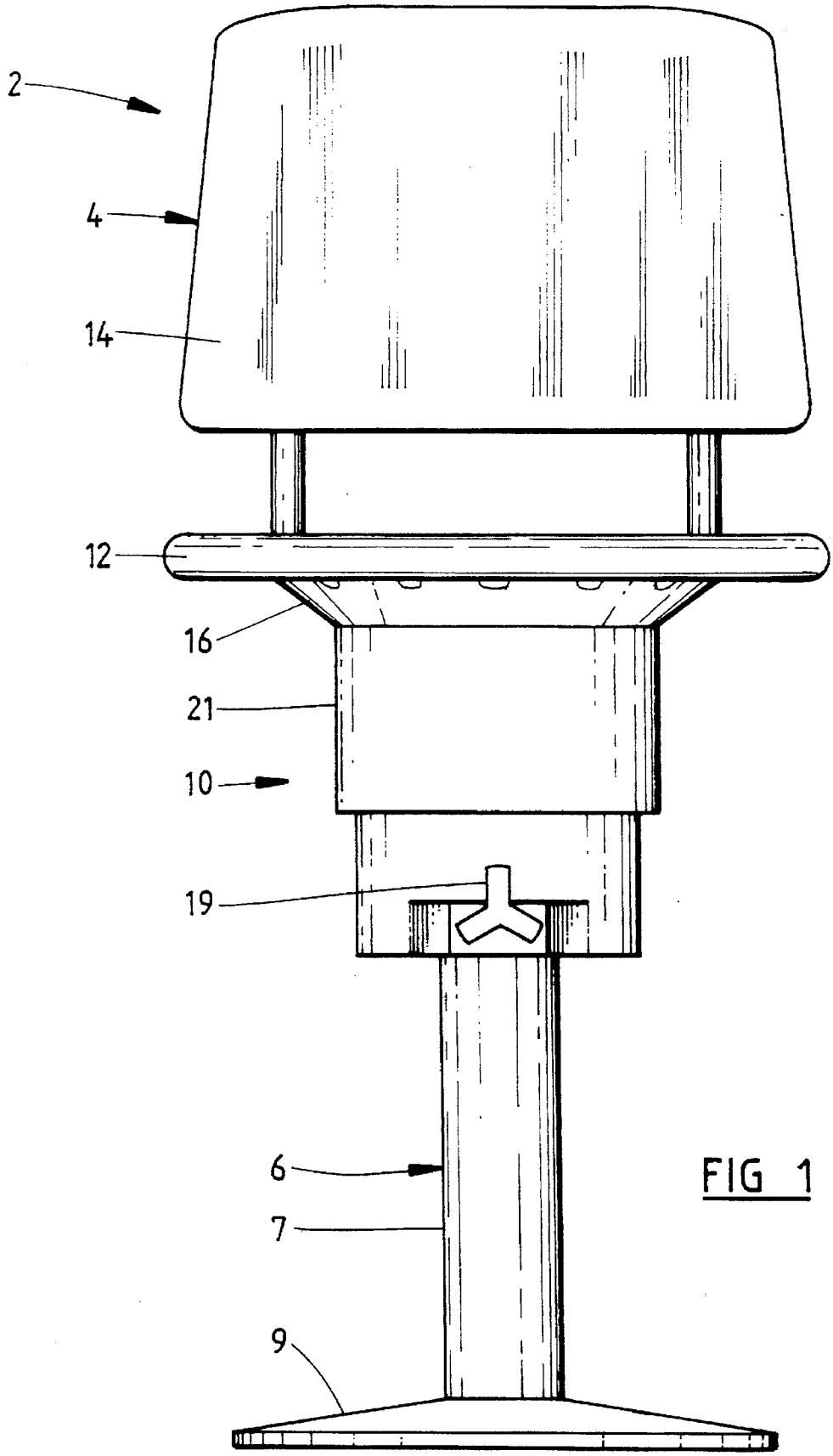
FIG. 1 is a side view of a seat support of the invention.

FIG. 1 illustrates a boat seat assembly 2 constructed in accordance with the invention. The assembly includes a seat 4 and a base 6, the seat being connected to the base by means of a mounting assembly 10 of the invention. The base 6 includes a pedestal 7 with a mounting plate 9 connected to its lower end for fixing to the floor or deck of a boat.

The seat 4 comprises a seat portion 12 and a back rest portion 14, the seat portion being connected to a seat support base 16 which forms part of the mounting assembly 10. The mounting assembly 10 includes a central housing 18, the lower end of which is connected to the top of the pedestal 7 by means of a screw clamp 19. A skirt 21 projects downwardly from the support base 16 so as to cover the upper part of the housing 18. The seat 4, base 16 and skirt 21 are all movable vertically relative to the central housing 18 and pedestal 7.

Figure 3:
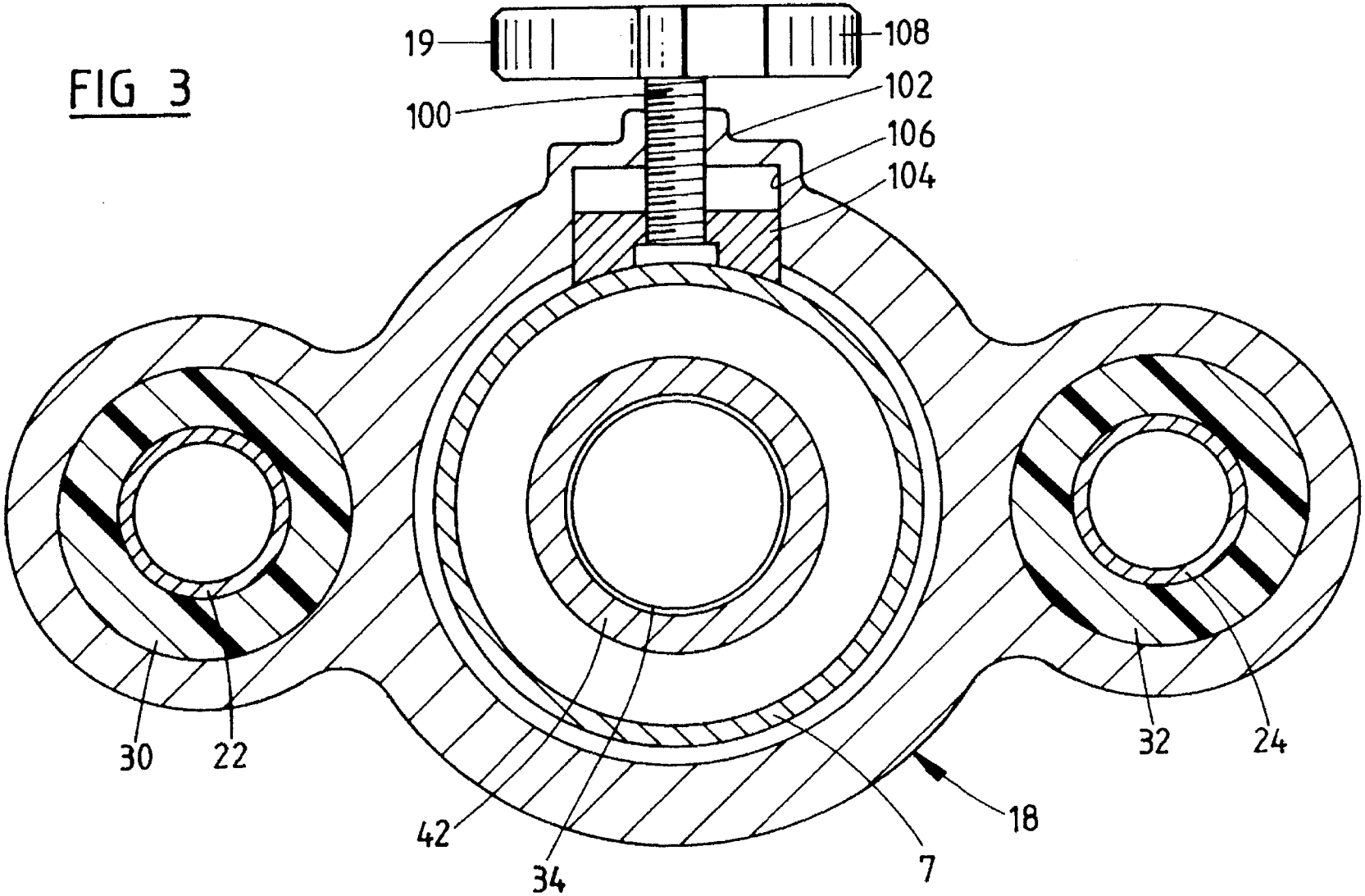
FIG. 3 is a transverse sectional view along the line 3—3.

FIG. 3 shows in more detail the clamp 19. It includes a threaded shaft 100 which is threadably mounted in a boss 102 which is formed integrally with the housing 18. A clamping block 104 is mounted for rotation on the inner end of the shaft 100. The block 104 is itself mounted for sliding movement in a recess 106 in the boss 102. An actuating knob 108 is provided on the free end of the shaft 100. The arrangement is such that the user can rotate the knob 108 in order to cause the clamping block to be moved inwardly and outwardly to thereby engage and disengage the outer surface of the pedestal 7.

Figure 2:
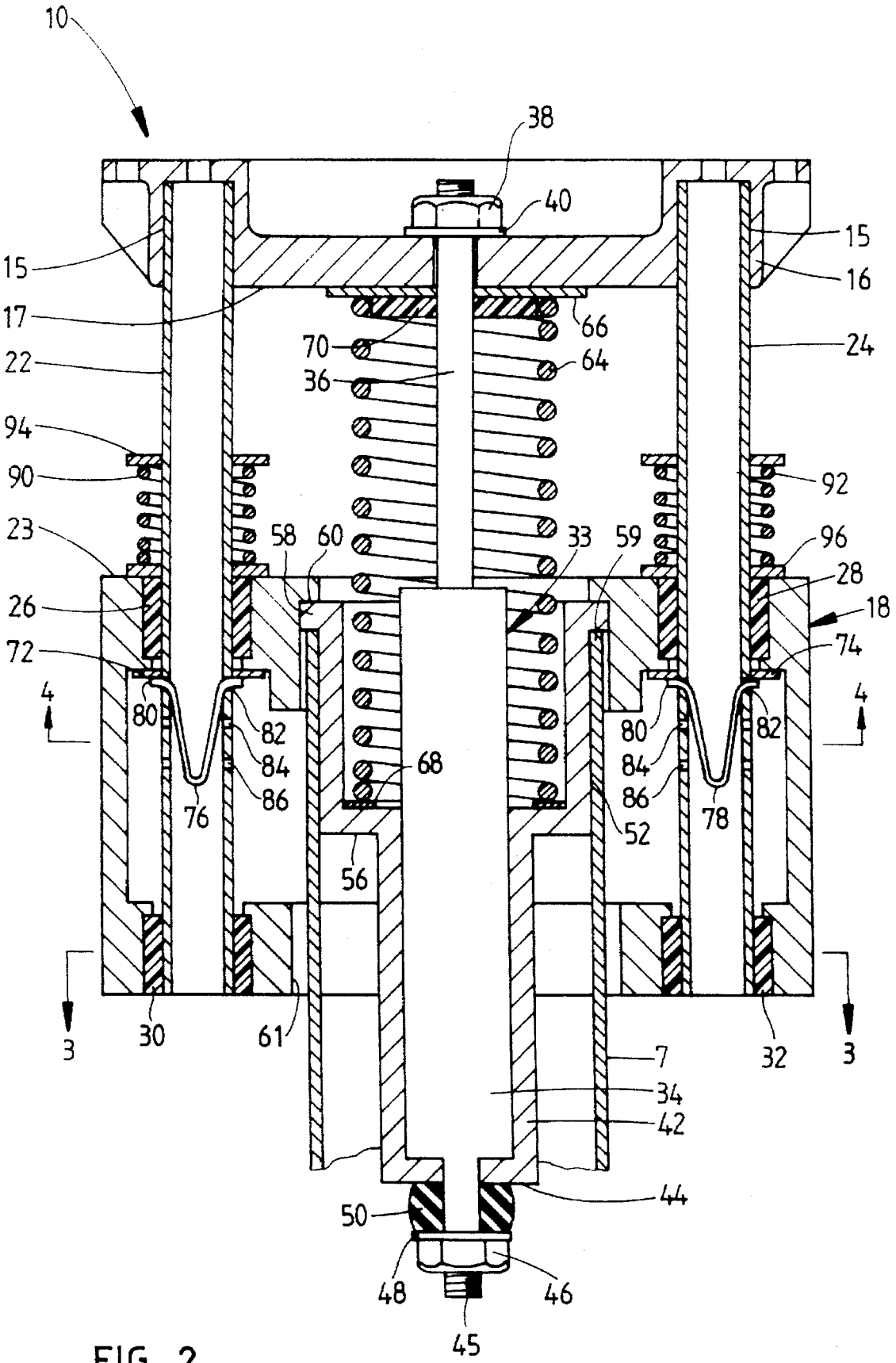
FIG. 2 is a sectional view of the invention.
Figure 4:
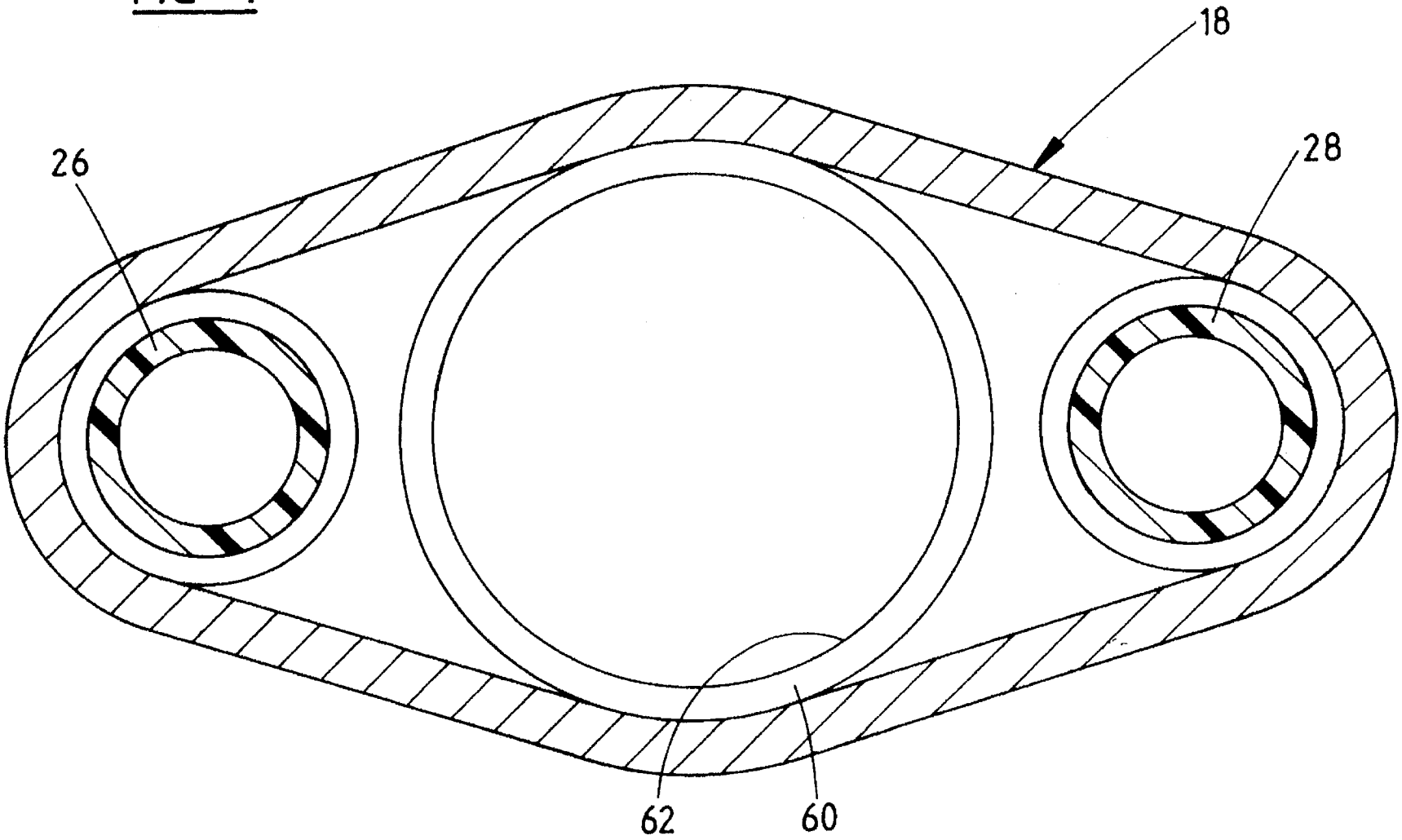
FIG. 4 is a transverse sectional view of the central housing along the line 4—4.

The mounting assembly 10 shown in FIGS. 2, 3 and 4 includes two hollow guide shafts 22 and 24 which are preferably formed from stainless steel. The upper ends of the guide shafts 22 and 24 are press fit into sockets 15 formed in the underside surface 17 of the support base 16. The guide shafts 22 and 24 pass through aligned openings in the central housing 18 so that the seat base 16 and guide shafts 22 and 24 are slidable downwardly relative to the central housing 18. The housing 18 is provided with upper nylon bushes 26 and 28 and lower nylon bushes 30 and 32 to provide relatively friction free sliding movement of the shafts 22 and 24 relative to the central housing 18.

The mounting assembly 10 includes a shock absorber 33 having a body portion 34 and a projecting shaft 36. The shaft 36 passes through an opening in the centre of the support base 16 and is connected thereto by means of a nut 38, a washer 40 being interposed between the nut and the base 16. The shock absorber body 34 is mounted within a tubular support body 42 having a closed end 44. A lower fixing shaft 45 of the shock absorber passes through the closed end 44 and is connected thereto by means of a nut and washer 46 and 48, a resilient washer 50 being interposed between the washer 48 and the end 44. A wider diameter portion 52 of the support body is connected to the lower part by means of a shoulder 56. The upper edge of the wider diameter portion 52 is provided with a flange 58. The flange 58 engages a shoulder 60 formed in a bore 62 which passes through the upper part of the central housing 18 to its upper surface 23.

In the illustrated arrangement, the pedestal 7 is tubular and the top edge 59 of the pedestal is received within the bore 62 and engages the underside of the flange 58. Typically the diameter of the pedestal 7 is 80 mm and the diameter of the bore 62 and the portion 52 are chosen so as to have a relatively snug fit with the upper part of the pedestal 7. The lower part of the housing 18 includes an access opening 61 to permit the pedestal to enter the bore 62 as described above. It will be further noted that the body 42 and portion 52 as well as the shock absorber body 34 are located within the upper end of the pedestal 7. This makes the arrangement compact and robust.

A compression spring 64 acts between the seat support base 16 and the shoulder 56 of the support body. The spring 64 surrounds the shaft 36 and part of the body 34 of the shock absorber. Washers 66 and 68 are provided adjacent to the underside surface 17 of the base 16 and the shoulder 56 to prevent these parts from being unduly worn by the spring 64. A relatively thick nylon washer 70 is mounted in the upper end of the spring 64 so as to keep the spring centred on the axis of the shaft 36.

When a downward compressive force is applied through the seat portion 12 the support base 16 will be moved downwardly against the resilient force of the spring 64 and the shock absorbing action of the shock absorber 34. This downward movement is guided by means of the guide tubes 24 and 26 passing through the openings in the central housing 18. This provides a comfortable suspended seat for a boat which is travelling in rough or choppy water.

In the preferred embodiment of the invention, the upward excursion of the seat base 16 is limited to a selectable amount whereby a preselected precompression of the spring 64 can be made. In the illustrated embodiment, this is achieved by providing limit washers 72 and 74 which surround the guide tubes 22 and 24. Movement of the washers 72 and 74 (downwards relative to the shafts 22 and 24) is limited by means of retaining clips 76 and 78. The clips 76 and 78 are generally U-shaped but have laterally projecting legs 80 which pass through aligned holes 82, 84 and 86 provided in the shafts 22 and 24. The holes 82, 84 and 86 are axially spaced along the shafts 22 and 24 and effectively limit the upward excursion of the shafts 22 and 24 depending upon which of the holes the legs 80 pass through. It is preferred that the preloading on the spring 64 is in the range 30 kg to 60 kg and preferably 40 kg. The selected preloading is a desirable feature because it substantially eliminates movement of the suspension caused by relatively small movements of the boat.

In the illustrated embodiment, secondary springs 90 and 92 are provided to provide additional resilience in the event of relatively large excursions of the seat 16 which for instance might be caused by the boat travelling in very rough water. The secondary springs 90 and 92 encircle the shafts 20 and 24 but are significantly shorter than the distance between the underside 17 of the base 16 and the upper surface 23 of the central housing 18. In this way the secondary springs 90 and 92 will not be compressed until there has been about 40% to 70% and preferably 50% of the normal excursion of the suspension. It is preferred that upper and lower washers 94 and 96 be provided above and below the respective ends of the springs 90 and 92 so as to protect the surfaces 17 and 23 from wear. The secondary springs 90 and 92 have an uncompressed length of about 60 mm and a diameter of about 35 mm.

It is preferred that the mounting assembly 10 is adjustable so that the excursion is in the range 50 mm to 70 mm and preferably 75 mm.

In the illustrated embodiment, the base 16, housing 18 and shock absorber support body 42 are made from die east aluminium. It is quite possible that these components could be moulded from suitable plastics material such as ABS or the like.

The shock absorber 34 can be of the type used in automotive or motorcycle applications. It may have an extended length of 294 mm and a compressed length of 187 mm, the body being about 34 mm wide. An Armstrong serial No. 610400 is a suitable example.

The compression spring 64 has a length of about 240 mm and a length of 125 mm when fully compressed. The outer diameter is preferably about 60 mm, the wire diameter being about 6.3 mm. One suitable spring has been tested with a 50 kg weight and its length reduced from 240 mm to 196 mm. The characteristics of the springs 90 and 92 are such that 15 kg will produce about 20 mm compression for each spring.

When the seat assembly 2 is mounted in a boat and the boat is buffeted by waves, the mounting assembly 10 acts as a suspension including shock absorption for the seat 4. More particularly, when the waves cause the boat's deck to rise, the pedestal 7 will rise but the full effect of this will not be transferred to the seat 4 and a passenger sitting on the seat. The inertia of the passenger and seat assembly will cause the shafts 30 and 32 to slide downwardly (relative to the tubes 26 and 28) together with compression of the spring 24 and of the shock absorber 20. This substantially reduces the amount of movement of the seat 4 making the ride much more comfortable and safer for the passenger.

It will be appreciated that the mounting assembly 10 can be used for supporting seats in other situations such as various forms of land vehicles and agricultural equipment and the like.

Many modifications will be apparent to those skilled in the art without departing from the spirit and scope of the invention.

I claim:

1. A shock absorbing assembly for coupling between a seat and a support structure for the seat, said assembly comprising:

first mounting means for connecting the shock absorbing assembly to the support structure;

second mounting means for connecting the shock absorbing assembly to the seat;

shock absorbing means coupled between the first and second mounting means;

first and second guide shafts, said first and second guide shafts being disposed on opposite sides of said shock absorbing means, and being operable to constrain relative movement of said first and second mounting means to reciprocating linear relative movement;

a compression spring which acts between said first and second mounting means; and spring precompression adjusting means for adjusting precompression of said compression spring.

2. An assembly as claimed in claim 1 wherein said first mounting means includes openings through which said first and second guide shafts pass.

3. An assembly as claimed in claim 2 wherein said shock absorbing means comprises a shock absorber having a shock absorber body and a shock absorber shaft and wherein the assembly includes a shock absorber mounting body in which the shock absorber body is mounted and wherein the shock absorber shaft is connected to said second mounting means.

4. An assembly as claimed in claim 3 further including a support structure comprising a pedestal and wherein the first mounting means includes a socket for receipt of the top of the pedestal and clamping means for clamping against a sidewall of the pedestal.

5. An assembly as claimed in claim 4 wherein the pedestal is tubular and wherein at least part of the shock absorber body is located therein.

6. An assembly as claimed in claim 5 wherein the shock absorber mounting body includes a flange which engages a top edge of said pedestal.

7. An assembly as claimed in claim 6 wherein the shock absorber mounting body includes a lower portion which snugly receives the shock absorber body and an upper portion which includes said flange, and wherein said upper portion is snugly received within said pedestal.

8. An assembly as claimed in claim 7 including a screw clamp mounted in first mounting means and having a clamping block which acts against said pedestal.

9. An assembly as claimed in claim 2 wherein the first mounting means comprises a housing and upper and lower bushes are provided in said openings for guiding the first and second guide shafts relative to the housing.

10. An assembly as claimed in claim 9 wherein the guide shafts are hollow and including holes therein, said assembly including clips which can be positioned in said shafts with parts of the clips projecting through said holes for cooperation with the housing, the positioning of the clips operable to adjust precompression of said compression spring.

11. An assembly as claimed in claim 1 wherein the precompression spring adjusting means adjusts the maximum separation of the first and second mounting means.

12. An assembly as claimed in claim 11 wherein the first and second guide shafts are hollow and the precompression spring adjusting means comprises projections from the first and second guide shafts which are engagable with shoulders in said first mounting means.

13. An assembly as claimed in claim 10 wherein the projections comprise end leg portions of first and second clips located in said first and second guide shafts respectively.

14. An assembly as claimed in claim 13 wherein a plurality of axially spaced holes are provided in said guide shafts through which said leg portions can be selectively passed.

15. An assembly as claimed in claim 1 including first and second auxiliary springs which are mounted on said first and second guide shafts respectively, said first and second auxiliary springs being arranged so that they do not resiliently act between the first and second mounting means until there has been a predetermined degree of compression of said compression spring.

16. An assembly as claimed in claim 1 including a skirt projecting downwardly from the second mounting means so as to cover at least an upper part of the first mounting means.

* * * * *